United States Patent [19]

Meinershagen et al.

[11] Patent Number: 4,526,423

[45] Date of Patent: Jul. 2, 1985

[54] BACK BRACE FOR DIRECTOR'S CHAIR

[76] Inventors: Charles I. Meinershagen; Susan G. Weale, both of P.O. Box 705, Redding, Calif. 96099

[21] Appl. No.: 501,113

[22] Filed: Jun. 6, 1983

[51] Int. Cl.[3] ..... A47C 7/00

[52] U.S. Cl. ..... 297/440; 297/441; 297/444; 248/188.91

[58] Field of Search ..... 297/440, 441, 444, 445; 248/188.91

[56] References Cited

U.S. PATENT DOCUMENTS

| | | | |
|---|---|---|---|
| 1,692,568 | 11/1928 | Prettyman | 248/188.91 |
| 1,703,879 | 3/1929 | Goldwyn | 155/140 |
| 1,739,552 | 12/1929 | Kidder | 155/140 |
| 1,799,029 | 3/1931 | Smith | 155/140 |
| 2,625,988 | 1/1953 | MacMillan | 297/444 X |
| 2,749,974 | 6/1956 | Finer | 297/445 X |
| 3,331,629 | 7/1967 | Munson et al. | 297/45 |
| 3,485,528 | 12/1969 | Kramer | 297/45 |
| 3,498,668 | 3/1970 | Vanderminden | 297/45 |
| 3,711,151 | 1/1973 | Upton | 297/45 |
| 3,977,721 | 8/1976 | Peterson | 297/45 |

*Primary Examiner*—Kenneth Downey
*Attorney, Agent, or Firm*—David Pressman

[57] ABSTRACT

A simple one-piece brace (20) provides rigidity to the vertical back of a director's chair (10). The brace consists of a curved length of heavy steel wire with a loop (22) on each end. Brace (20) is made long enough so that each of its end loops (22) fits over the respective two round uprights (12) of the chair. The brace is installed by removing the canvas backpiece (14) of the chair and fitting the end loops of the brace over the respective uprights and then re-installing the backpiece. The brace is curved so that it does not interfere with the back of a person sitting in the chair.

3 Claims, 2 Drawing Figures

BACK BRACE FOR DIRECTOR'S CHAIR

BACKGROUND

1. Field of Invention

This invention relates generally to chairs, particularly to an improvement for a collapsible chair of the director's type.

2. Prior Art

Director's chairs have been widely used for many years and are most commonly made of wooden structural members and some type of fabric or canvas for the seat and back rest portions. These chairs come in many particular styles, shapes, and sizes, ranging from low profile lounge chairs to high, narrow bar chairs. While such director's chairs have been very popular primarily due to their styling, simplicity, comfort, and ease of storage, they have one major shortcoming: a lack of structural integrity in the vertical members of said chair.

In particular, long-term use of the director's chair has proven, in the past, to be destructive to the glued and/or screwed wooden joints that hold the vertical back members to the overall frame of the chair. This has allowed the vertical members to loosen and lean inward, toward each other, whenever a person sits in the chair, making the chair both uncomfortable and unsafe.

OBJECTS AND ADVANTAGES OF THE INVENTION

One object of the invention is to provide a means for improving the structural integrity of rigidity of a director's chair. Other objects are to provide a means for enhancing the strength and rigidity of such a chair without interfering with its advantages of collapsibility, ease of storage, shape, comfort, styling, and without necessitating any change in the structure, style, color, collapsibility, or stability of the chair. Further objects are to provide such means in which brace can be made of a variety of materials which allow brace to conform to a person's back curvature and thus be comfortable. Still further objects and advantages will become apparent from a consideration of the ensuing description, taken in conjunction with the accompanying drawings.

DESCRIPTION OF THE INVENTION

Figure 2:
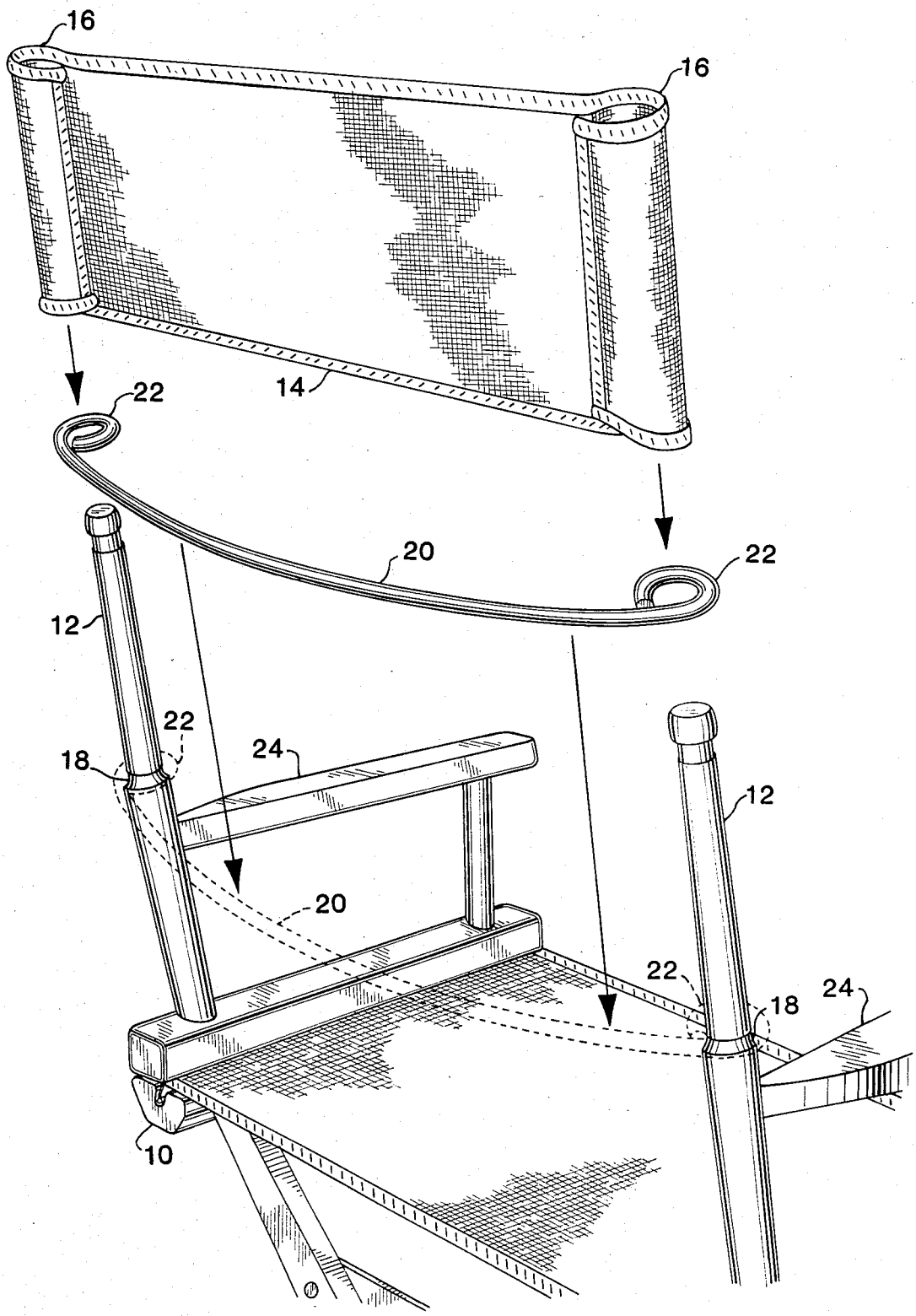
FIG. 2 is a close-up exploded perspective view of the chair with the improvement of the invention illustrating the number of installation.

As shown in the drawings, a director's chair comprises a conventional hinged and pivotably interconnected frame assembly 10. Frame assembly 10 includes two cantilevered vertical members or uprights 12 which support a flexible canvas backpiece 14. Backpiece 14 comprises a web part with two parallel end loops or tubes 16 (best seen in FIG. 2) which telescope or slide over uprights 12 and which come to rest or are stopped by widened portions, or the arm members 24, or circumferential ledges 18 of uprights 12. Frame 10 is normally collapsed or folded easily to a compact arrangement by removing flexible backpiece 14 and folding side vertical members 12 down laterally and collapsing frame 10 by laterally closing the hinged and pivoted interconnecting diagonal legs.

In use, the two cantilevered vertical members 12 are the sole support for backpiece 14 that stretches between members 12. When a person is sitting in the director's chair and applying normal back pressure to backpiece 14, considerable inward force is applied to members 12. This inward force causes members 12 to lean toward each other, causing discomfort to the person sitting in the chair. This inward lean of members 12 is most pronounced after years of continuous use; however, it is often evident even when the chair is new.

In accordance with the present invention, the foregoing disadvantages are overcome by a brace 20 which is installed (FIG. 2) on uprights 12 by removing canvas backpiece 14 (if it is not already removed) and then fitting end loops 22 of brace 20 over uprights 12 until they rest on ledges 18 or horizontal arm members 24. In the example shown in the drawings, brace 20 is constructed in one piece of 9.5 mm (0.675 inch) diameter round steel wire. Brace 20 has a length of 57.2 cm (22.5 inches) a curve radius of 61 cm (24 inches), and loop 22 at each end has an inside diameter of 28.6 mm (1.125 inches). Brace 20 thus has a curved configuration which provides an arc which subtends a chord extending in a straight line between uprights 12. The overall length of brace 20 and the diameter of loops 22 can be varied to fit the size of the particular director's chair on which it is to be used. The distance between the centers of the vertical members 12 typically range from 45.7 cm (18 inches) to 53.3 cm (21 inches) on director's chairs. The diameter of vertical members 12 varies from 2.5 cm (1 inch) to 3.2 cm (1.25 inches).

After brace 20 is installed, backpiece 14 is simply placed in its normal position by fitting its end loops 16 over uprights 12 as indicated, whereupon loops 16 will rest on loops 22 of brace 20, in lieu of on ledges 18.

Figure 1:
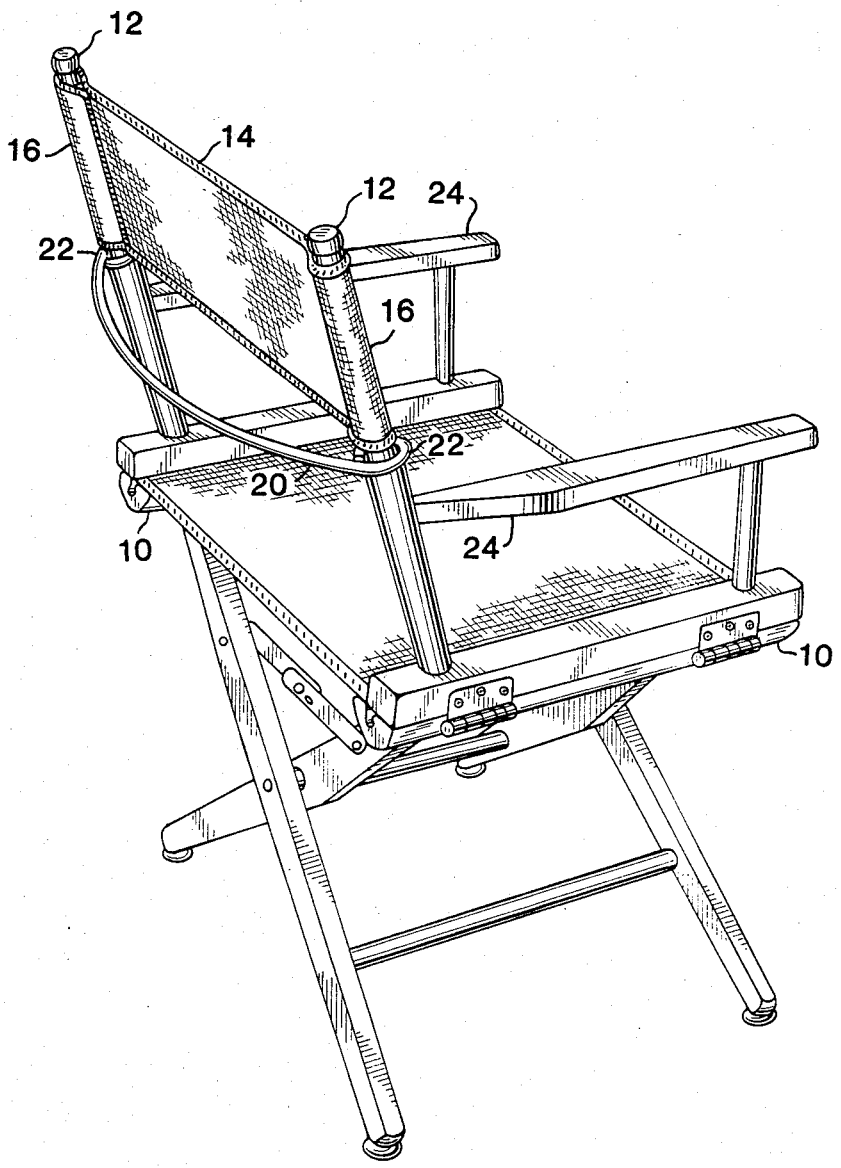
FIG. 1 is a perspective view of a typical director's chair with the the improvement of the present invention in place.

With brace 20 and backpiece 15 in place (FIG. 1), the structural integrity and rigidity of the vertical members 12 is significantly enhanced. The parallelism of members 12 is mostly maintained even while a person sitting in the chair is exerting back pressure on backpiece 14.

While brace 20 is shown with a round cross-section, it can be made of oval, rectangular, or even flattened stock. Brace 20 also can be constructed either of plastic, fiberglass, or any other rigid, semi-rigid, or semi-flexible material, or a combination of such materials; brace 20 need merely be stiff enough to hold uprights 12 apart in normal use. In practice, a brace of 57.2 cm (22.5 inches) long should not compress more than about 2.54 cm (1 inch) in distance between end loops when a lateral force of 6.8 kg (15 lb) is applied to the center of the brace, which is approximately equivalent to the force resulting from a person leaning backward in a chair. The flexibility of the material used will render the brace more easily adaptable to a wider range of sizes of director's chairs while maintaining both the structural integrity and comfort for the user.

It is thus seen that brace 20 completely overcomes the disadvantage of director's chairs whereby the back uprights thereof tend to lean together. This is done with an economical, reliable, easy-to-install addition which does not interfere with the styling, collapsibility, portability, storability, or comfort of the chair, or its adaptability to persons of various physical sizes.

While the above description contains many specificities, these should not be construed as limitations on the scope of the invention, but rather as an exemplification of one preferred embodiment thereof. Accordingly, the full scope of the invention should be determined not by the examples given, but by the appended claims and their legal equivalents.

I claim:

1. A brace for a collapsible chair of the type employing two substantially parallel cantilevered members, said brace comprising a wire member having a dimension substantially equal to the spacing between said cantilevered members and containing a pair of loops at the ends thereof for removable attachment around said respective cantilevered members, said wire member having a curved configuration which provides an arc which subtends a chord extending in a straight line between said respective loops thereof, said wire member being sufficiently rigid to hold said cantilevered members apart when said chair is in use.

2. A brace of a collapsible chair of the type employing two substantially parallel cantilevered members, said brace comprising a wire member having a dimension substantially equal to the spacing between said cantilevered members and containing means at the extremities thereof in the direction of said dimension for removable attachment to said cantilevered members, said means comprising respective loops at the ends of said wire member for engagement around said respective cantilevered members, said wire member being sufficiently rigid to hold said cantilevered members apart when said chair is in use.

3. A brace for a collapsible chair of the type employing two substantially parallel cantilevered members, said brace comprising a member having a dimension substantially equal to the spacing between said cantilevered members and containing means at the extremities thereof in the direction of said dimension for removable attachment to said cantilevered members, said brace being sufficiently rigid to hold said cantilevered members apart when said chair is in use, said brace comprising a wire member, said means comprising wire loops at the ends of said wire member for engagement around said respective cantilevered members, said wire member having a curved configuration which provides an arc which subtends a chord extending in a straight line and between said respective loops thereof.

* * * * *